US005092694A

United States Patent [19]

Haczek

[11] Patent Number: 5,092,694

[45] Date of Patent: Mar. 3, 1992

[54] RIBBON CASSETTE FOR A TYPEWRITER OR THE LIKE

[75] Inventor: Werner Haczek, Nuremberg, Fed. Rep. of Germany

[73] Assignee: TA Triumph-Adler, Nuremburg, Fed. Rep. of Germany

[21] Appl. No.: 637,579

[22] Filed: Jan. 4, 1991

[30] Foreign Application Priority Data

Jan. 5, 1990 [DE] Fed. Rep. of Germany ..... 4000195

[51] Int. Cl.[5] ..... B41J 35/28

[52] U.S. Cl. ..... 400/208; 188/83; 188/166; 242/75.45; 400/234

[58] Field of Search ..... 400/207, 208, 228, 234; 188/77, 83, 166; 242/75.4, 75.45

[56] References Cited

U.S. PATENT DOCUMENTS 4,502,801 3/1985 Hefti et al. ..... 400/234 X
4,505,605 3/1985 Hasegawa et al. ..... 400/234 X
4,609,298 9/1986 Shioda ..... 400/234 X
4,623,273 11/1986 Gubau ..... 400/234 X

*Primary Examiner*—Edgar S. Burr
*Assistant Examiner*—Moshe I. Cohen
*Attorney, Agent, or Firm*—Browdy and Neimark

[57] ABSTRACT

In a ribbon cassette for a typewriter or the like, comprising a housing, a take-off spool core rotatably seated in the housing, on which a take-off ribbon spool is wound, and a take-up spool core, also rotatably seated in the housing, where the take-off spool core is rotatably seated in the housing vertically to its axis of rotation, and where a loop brake spring with two legs and with a section in the shape of a segment of a circle connecting the legs and looping around the take-off spool core is provided, an expanding guide device (19) on the housing, which acts on the spring legs (14, 15) for achieving an even and defined ribbon tension, is provided in such a way, that with increasing unwinding and corresponding displacement of the takeoff spool (5) in the housing (1), the spring legs (14, 15) are increasingly spread open, while the braking force is reduced.

4 Claims, 1 Drawing Sheet

RIBBON CASSETTE FOR A TYPEWRITER OR THE LIKE

BACKGROUND OF THE INVENTION

1. Field of the Invention

The invention relates to a ribbon cassette for a typewriter or the like, comprising a housing, a take-off spool core rotatably seated in the housing, on which a take-off ribbon spool is wound, and a take-up spool core, also rotatably seated in the housing, where at least the take-off spool core is rotatably seated in the housing vertically to its axis of rotation, and where a loop brake spring with two legs and with a section in the shape of a segment of a circle connecting the legs and looping around the take-off spool core is provided.

It is intended by means of the movable seating of the takeoff spool core provided in such cassettes to take up a space corresponding to less than twice the diameter of the take-off spool, and to allow the axis of rotation of the take-off spool to come closer to the housing wall, so that the space available for the take-up spool, the diameter of which grows larger, is increased.

2. Description of Prior Art

It is known in the prior art to provide for such ribbon cassettes a brake spring for the take-off spool in order to prevent an undefined unwinding process because of vibrations during operation or transport, as well as to maintain defined ribbon tension.

To keep the ribbon tension constant, while the diameter of the take-off spool is decreasing, it is necessary that the braking force be reduced in the course of the typing process, i.e. with increasing use of the ribbon.

To achieve this it is known, for example from German Utility Model DE-GM 89 09 019, to roughen or abrade the spring in the area where it rests against the take-off spool core, so that the take-off spool core is ground down by the spring in the course of operation and the effective diameter is reduced in this way, which is also coupled with a progressively reduced brake effect.

It is known from German Letters Patent DE-PS 25 52 154 to provide brake elements, in contact with the take-off spool and extending radially over the ribbon, which exert a frictional brake force on the unwound ribbon, the effective friction surface of these brake elements changing in a radial direction, so that the brake force changes too as a function of the still available amount of ribbon or the diameter of the take-off spool.

Both known solutions have the disadvantage that, although the fictional forces are to be correctly altered in intent, a defined setting of the ribbon tension independently of outside influence, such as temperature and humidity and the like, cannot be sufficiently assured.

SUMMARY OF THE INVENTION

Based on this it is the object of the invention to assure in a structurally simple way in a ribbon cassette of the previously mentioned species that constant ribbon tension is achieved during the entire operation, even if the spool core of the take-off spool is displaced in relation to the housing of the ribbon cassette.

This object is attained in accordance with the invention by means of an expanding guide device on the housing, acting on the spring legs such, that with increasing unwinding and corresponding displacement of the take-off spool in the housing, the spring legs are increasingly spread open, while the braking force is reduced.

In this way the relative displacement of the spools is utilized which, by itself, has caused the problem in regard to the constant adjustment of the ribbon tension, to generate a proportional and defined reduction of the braking force. In this connection it is possible to preset the course of the braking force reduction very easily and exactly by the shaping of the expanding guide device.

The term "expanding guide device" means an element which spreads the legs of the brake spring against its resilience, for example a wedge-shaped element on the outside of which the outer faces of the legs of the spring act, as well as an element which maintains the brake spring in its initial position under a defined bias and with the displacement allows a spreading in the direction of the resilience, for example a key slot, on the inside of which the spring lets of the biased brake spring act.

Thus it is essential for the invention in regard to the design of the expanding guide device that by means of the displacement of the take-off spool core inside the cassette the brake force in relation to the latter is reduced in the course of increasing unwinding. With crossed spring legs, for example, the outer ends of the spring legs can also be moved towards each other, while the parts of the spring legs located on the inside are spread and the brake force is reduced, It is provided in a preferred embodiment that the spring legs have crimped ends which engage the expanding guide device. It is possible in this way to achieve in a particularly simple manner a defined notch guide, where the crimped ends act for all practical purposes as tracing cams.

In an advantageous manner the expanding guide device is formed by a wedge element connected with the housing. For example, the wedge element can be extruded on the side wall or on the bottom or lid of the housing, which means that it does not require additional assembly efforts. In this connection the term wedge element should be understood in the general sense of the word, i.e. the guide surfaces do not necessarily have to extend linearly, but may be curved for obtaining a defined course of braking.

It can furthermore be provided that guide elements are disposed laterally of the wedge element, the crimped ends of the spring legs being slidingly disposed between the wedge element and each one of the guide elements. Thus it is measured by means of the guide elements that the spring ends actually are guided along the wedge element.

It has been provided in an alternate embodiment that the expanding guide devices are formed by key slots on the housing, which are engaged by crimped ends of the spring legs. These key slots may be formed by a single wedge-shaped recess or by two separate grooves in the literal sense of the word. In this case, too, a curved design of the guide walls of the grooves is possible.

The invention will be described in detail by means of a preferred embodiment in connection with the drawings.

DETAILED DESCRIPTION OF THE PREFERRED EMBODIMENT

Figure 1:
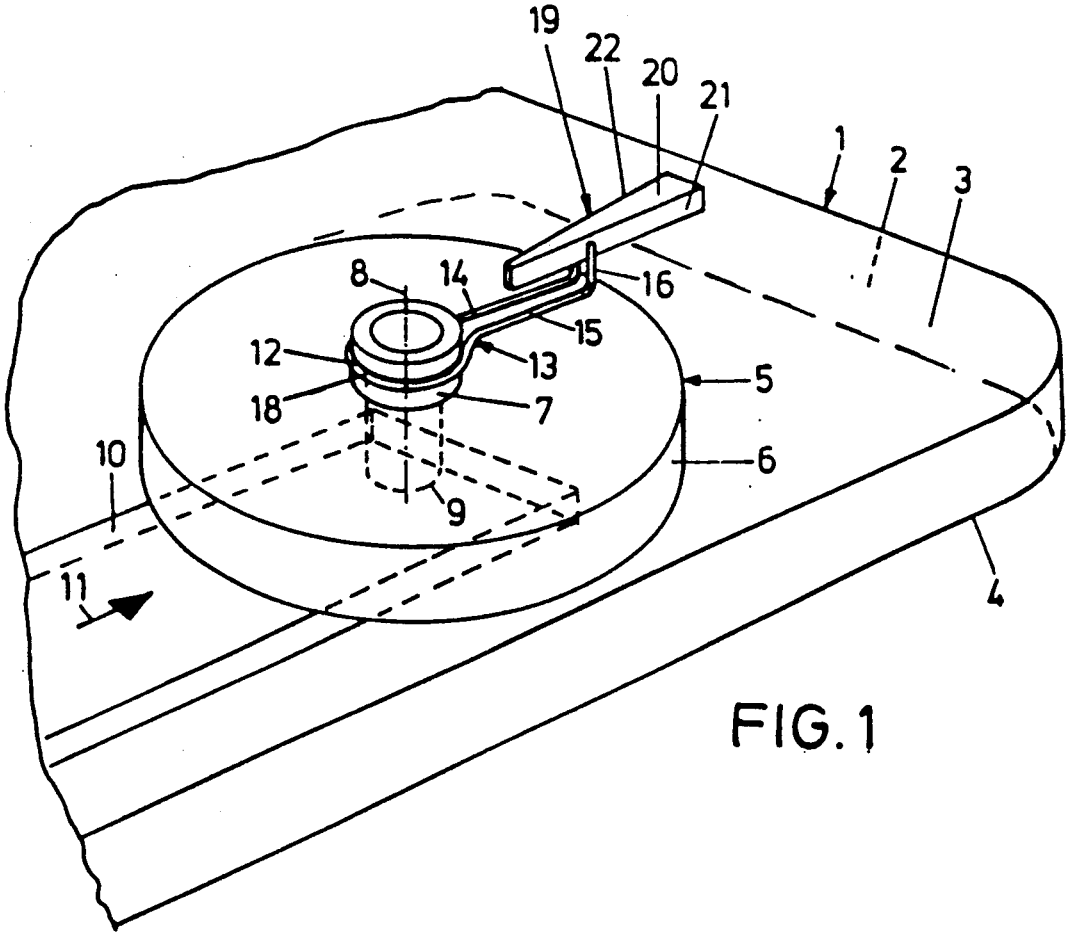
FIG. 1 is a schematic, perspective partial view of a ribbon cassette in accordance with the invention.

A ribbon cassette, such as is shown and described in detail in the previously mentioned references, for example, is shown in FIG. 1 in a partially perspective view. It comprises a housing 1 consisting of a side wall 2, a transparent lid 3, and a bottom 4.

A take-off spool 5 in the housing 1, formed by a ribbon 6 with a take-off spool core 7, is rotatably seated on a rotating shaft 8. The bearing 9, only schematically indicated, is disposed on a bar 10, which is seated in the housing 1 displaceable in the direction of the arrow 11 depending on the amount of ribbon left on the take-off spool 5.

Figure 2:
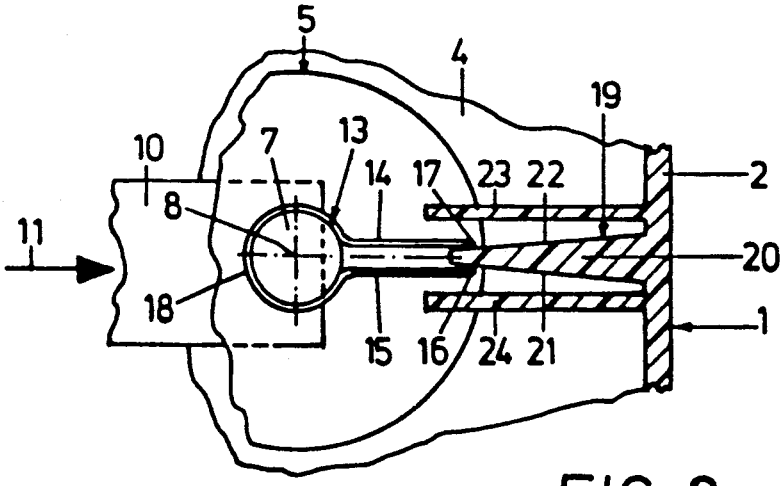
FIG. 2 is a horizontal section of the expanding guide device.

A loop brake spring 13 is disposed in a groove 2 of the take-off spool core 7 which, as particularly shown in FIG. 2, has two spring legs 14, 15 with crimped ends 16, 17. The two spring legs 14, 15 are connected with each other by means of a section 18 in the shape of a segment of a circle, which extends over an angle of nearly 360. in the groove of the spool core 7.

The crimped ends 16, 17 of the spring 13 lie against an expanding guide device 19 in the form of a wedge 20, extruded from the housing wall 2, with lateral wedge surfaces 21, 22. The wedge surfaces 21, 22, which are in engagement with the spring ends 16, 17, are used as cam guide surface when the take-off spool 5 together with the bar 10 is moved in the direction of the arrow 11 and, correspondingly, the spring ends 16, 17 are also moved in the direction of the arrow 11, i.e. to the right in the drawing. With increased movement in the direction of the arrow 11, the distance between the guide surfaces 21, 22 increases, so that the spring ends 16, 17 are at a larger distance from each other and the spring 13 is spread open while the braking force is reduced.

Accordingly it is possible to achieve by means of the device in accordance with the invention the desired goal of reducing the braking force in the course of increased unwinding of the ribbon from the take-off spool 5, i.e. with increasing movement towards the housing wall 2 in the direction of the arrow 11.

In order to simplify assembly and to achieve an assured seating of the ends 16, 17, guide elements 23, 24 may be provided on both sides of the wedge element 20, which are in the form of protrusions and can also be extruded from the housing side wall.

What is claimed is:

1. A ribbon cassette for a typewriter or the like, comprising a housing, a take-off spool core rotatably seated in the housing, a take-off ribbon spool mounted on said spool core, the take-off spool core being seated on the housing and rotatable about a vertical axis of rotation, a loop brake spring with two legs and with a section in the shape of a segment of a circle connecting the legs and looping around the take-off spool core, means mounted on the housing for expanding the spring legs by acting on the spring legs (14, 15) to increasingly spread them open and reduce the braking force with increased unwinding and corresponding displacement of the takeoff spool (5) in the housing (1).

2. A ribbon cassette in accordance with claim 1, characterized in that the spring legs (14, 15) have crimped ends (16, 17) which engage with said means for expanding.

3. A ribbon cassette in accordance with claim 1, characterized in that the means for expanding is a wedge element (20) connected to the housing (1).

4. A ribbon cassette in accordance with claim 3, including guide elements (23, 24) disposed laterally of the wedge element (20), the spring was having crimped ends (16, 17) slidingly disposed between the wedge element (20) and the guide elements (23, 24).

* * * * *